US009682810B2

(12) United States Patent
Fisher

(10) Patent No.: US 9,682,810 B2
(45) Date of Patent: Jun. 20, 2017

(54) FOOTWEAR BAG WITH ATTACHED MITTEN

(71) Applicant: LyLy Le Fisher, Austin, TX (US)

(72) Inventor: LyLy Le Fisher, Austin, TX (US)

( * ) Notice: Subject to any disclaimer, the term of this patent is extended or adjusted under 35 U.S.C. 154(b) by 48 days.

(21) Appl. No.: 14/708,832

(22) Filed: May 11, 2015

(65) Prior Publication Data

US 2016/0332803 A1 Nov. 17, 2016

(51) Int. Cl.

| | |
|---|---|
| ***A47L 1/15*** | (2006.01) |
| ***B65D 85/18*** | (2006.01) |
| ***A47L 23/28*** | (2006.01) |
| ***B65D 30/22*** | (2006.01) |
| ***B65D 33/28*** | (2006.01) |
| ***A47L 23/10*** | (2006.01) |

(52) U.S. Cl.

CPC ..... *B65D 85/187* (2013.01); *A47L 23/10* (2013.01); *A47L 23/28* (2013.01); *B65D 31/12* (2013.01); *B65D 33/28* (2013.01)

(58) Field of Classification Search

CPC .... B65D 85/18; B65D 85/182; A61B 19/045; A47G 25/54; A45C 3/12

USPC ..... 206/278, 210, 296, 438; 401/6, 7; D7/709; 15/227; 2/159, 160; 383/41; D9/415, 705, 707, 734

See application file for complete search history.

(56) References Cited

U.S. PATENT DOCUMENTS

| | | | | |
|---|---|---|---|---|
| 1,818,030 A | | 8/1931 | Arnold | |
| 2,044,428 A | | 6/1936 | Gilmer | |
| 2,279,100 A | * | 4/1942 | Goldsmith | A45D 33/00 15/227 |
| 2,323,098 A | | 6/1943 | Mintzes et al. | |
| 2,351,407 A | | 6/1944 | David | |
| 2,668,309 A | * | 2/1954 | Colgan | A47K 7/03 15/227 |
| 2,795,806 A | * | 6/1957 | Suttles | A47L 13/19 15/227 |
| 3,608,708 A | | 9/1971 | Storandt | |
| 3,777,328 A | | 12/1973 | Kaplan | |
| 3,982,298 A | | 9/1976 | Ota | |
| 4,069,913 A | * | 1/1978 | Harrigan | A61B 42/40 128/856 |
| 4,788,733 A | | 12/1988 | Lerner | |
| 4,902,283 A | * | 2/1990 | Rojko | A47K 7/02 15/227 |
| 4,959,881 A | * | 10/1990 | Murray | A47L 13/18 15/104.94 |
| 4,964,188 A | * | 10/1990 | Olson | A41D 19/0075 15/227 |
| 5,065,863 A | * | 11/1991 | Moyet-Ortiz | A61B 42/40 206/210 |

(Continued)

FOREIGN PATENT DOCUMENTS

| | | |
|---|---|---|
| EP | 1741362 A2 | 10/2007 |
| WO | 9610356 A1 | 4/1996 |
| WO | 0131109 A1 | 5/2001 |

*Primary Examiner* — Fenn Mathew
*Assistant Examiner* — Cynthia Collado
(74) *Attorney, Agent, or Firm* — George L Murphy; Murphy Strategic IP

(57) ABSTRACT

This application describes a footwear storage bag having a fabric bag body and an attached fabric mitten for cleaning, shining, or polishing footwear. The mitten may be attached to the bag body or to a means for closing the bag. The bag body and mitten may have a variety of shapes.

8 Claims, 6 Drawing Sheets

(56) References Cited

U.S. PATENT DOCUMENTS

| | | | | |
|---|---|---|---|---|
| 5,075,918 | A | 12/1991 | Zeltner et al. | |
| D322,888 | S | 1/1992 | Crawford et al. | |
| 5,152,612 | A | 10/1992 | Shoemaker | |
| 5,297,872 | A | 3/1994 | Caligiuri | |
| 5,301,806 | A * | 4/1994 | Olson | A41D 19/0068 15/227 |
| 5,490,619 | A | 2/1996 | Boyar | |
| 5,924,160 | A * | 7/1999 | Bradley | A47K 7/02 15/227 |
| 6,050,726 | A | 4/2000 | Hoerl | |
| 6,233,742 | B1 * | 5/2001 | Yungkurth | A41D 19/002 2/160 |
| 6,241,580 | B1 | 6/2001 | Fisher | |
| 6,305,843 | B1 * | 10/2001 | Helmer | A41D 19/0075 206/278 |
| D453,994 | S | 3/2002 | Meissner | |
| 6,494,767 | B2 | 12/2002 | Fisher | |
| 6,588,961 | B2 | 7/2003 | Lafosse-Marin et al. | |
| 8,672,546 | B2 | 3/2014 | Jariwala et al. | |
| 8,944,682 | B2 | 2/2015 | Lee | |
| 2007/0181451 | A1 | 8/2007 | Jones | |
| 2007/0189639 | A1 | 8/2007 | Revness | |
| 2008/0235985 | A1 | 10/2008 | Gordon | |
| 2008/0244807 | A1 * | 10/2008 | Borrie | A41D 19/0075 2/160 |
| 2009/0148078 | A1 | 6/2009 | Skyler | |
| 2011/0023250 | A1 | 2/2011 | Bernard et al. | |
| 2012/0076440 | A1 | 3/2012 | Gallagher | |
| 2012/0128271 | A1 | 5/2012 | Dias | |
| 2013/0039605 | A1 | 2/2013 | Gavrieli et al. | |
| 2014/0260110 | A1 | 9/2014 | Joseph-de Saram et al. | |

* cited by examiner

FOOTWEAR BAG WITH ATTACHED MITTEN

FIELD OF THE INVENTION

This invention is in the field of flexible bags, particular relating to a flexible footwear bag having an attached mitten.

GENERAL DESCRIPTION OF THE INVENTION

Numerous styles of footwear bag have been described and are commercially available. U.S. Pat. App. Pub. US20080235985 describes a washable, waterproof mesh bag for holding boots or galoshes, the outer boots or galoshes being designed to be worn over other footwear. The washable mesh bag may be inserted into an outer waterproof container for storing the boots when wet or removed for hanging and drying the boots after use. Europe App. Pub. EP 1741362A2 describes a bag for storing and carrying footwear and/or other items. U.S. Pat. App. Pub. US20070181451 describes a bag having a zipper closure for storing boots, and U.S. Pat. App. Pub. US20120128271 describes a drawstring shoe bag having a central fabric divider bisecting the shoe bag and having a concealed pocket. U.S. Pat. No. 1,818,030 describes a shoe bag having a moveable partition, which may have one or more pockets for holding cleaning articles and accessories. Many types of polishing mittens for polishing shoes are known. Exemplary mittens are described in U.S. Pat. Nos. 6,241,580; 3,982,298; and 3,608,708 and U.S. Pat. App. Pub. 20110023250A1.

Many situations require the transport and/or storage of footwear. For example, travellers often use bags or boxes for storing and transporting footwear in suitcases so as to prevent soiling of cloths and other items in their suitcase. Frequently, travelers will encounter a need to clean, shine, or polish their footwear and will find themselves without the necessary means for doing so. It is not uncommon for hotels, motels, and other lodging establishments to furnish their rooms with various toiletries and other sundries for use by travelers staying at those establishments. Often shoeshine tissues are included among the sundries provided. However, not all establishments provide these amenities, and frequently such shoeshine tissues that are provided are extremely small or delicate so as to be difficult to use and easy to tear. The inventor has found that a footwear bag for transporting or storing footwear with an attached mitten that is suitable for cleaning, shining, polishing, or dusting footwear for example, provides a useful package for footwear care. Travelers using footwear bags of the invention will not find themselves without a means for cleaning or shining footwear upon arrival at their destination. Additionally, the attached fabric mittens for use in embodiments of the invention are configured to fit a human hand, thus providing a relatively larger surface area for use when cleaning or shining footwear.

Embodiments of the invention are useful in many other situations as well. By way of example only, working commuters who change shoes upon arrival at their place of work will find the footwear bag useful for storing and caring for their commuting footwear and destination footwear. Similarly, the footwear bag with attached mitten would be useful during inclement weather, when exposure to the elements requires a change and cleaning of shoes. Storing and transporting footwear in a bag of the invention is also useful for protecting clothing and other objects, which may otherwise come in contact with footwear, from being soiled. Users will find that a means for cleaning or polishing footwear is readily available and attached to the footwear bag. Of course, the footwear bag may also be used to store and transport other items. As can be seen, embodiments of the invention will find use in a variety of situations.

Provided herein is a bag for storing and transporting footwear comprising a flexible fabric body having an opening and defining an internal chamber. The bag further comprises a means for securing the bag in a closed position, and a flexible fabric mitten attached to the bag and having a closed end and an opposing open end, the open end without a closure means, wherein the mitten is configured for receiving a hand, and wherein the mitten is attached to and extendable from the flexible fabric body.

In some embodiments of the invention, the open end of the attached mitten is positioned substantially adjacent to the bag opening. In embodiments of the invention, the mitten may be fixedly or removably attached to the bag body or the bag closure means. In some aspects of the invention, the mitten is attached to an internal side of the bag body adjacent to the defined internal chamber. In some embodiments, the mitten is attached to an internal side of the bag by stitching, and the open end of the mitten is substantially adjacent to the bag opening. In some aspects of the invention the mitten comprises a section for receiving a thumb of a human hand and a separate section for receiving fingers of a human hand.

Other embodiments of the invention are discussed throughout this application. Embodiments described herein are understood to be applicable to all aspects of the invention. It is contemplated that any embodiment discussed herein can be implemented with respect to any composition of the invention, and vice versa.

The use of the word "a" or "an" when used in conjunction with the term "comprising" in the claims and/or the specification may mean "one," but it is also consistent with the meaning of "one or more," "at least one," and "one or more than one." The use of the term "at least one" in the specification and claims is meant to include "one or more than one", and the use of the term "one or more than one" is meant to include "at least one".

Throughout this application, the term "about" is used to indicate that a value includes the standard deviation of error for the device or method being employed to determine the value.

The use of the term "or" in the claims is used to mean "and/or" unless explicitly indicated to refer to alternatives only or the alternatives are mutually exclusive, although the disclosure supports a definition that refers to only alternatives and "and/or." It is also contemplated that anything listed using the term "or" may also be specifically excluded.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The citation of any references herein is not an admission that such references are prior art for the present invention. It should be understood that the detailed description and the specific examples, while indicating specific embodiments of the invention, are given by way of illustration only, since various changes and modifications within the spirit and scope of the invention will become apparent to those skilled in the art from this detailed description. Other objects, features and advantages of the present invention will become apparent from the following detailed description.

DETAILED DESCRIPTION

Figure 1:
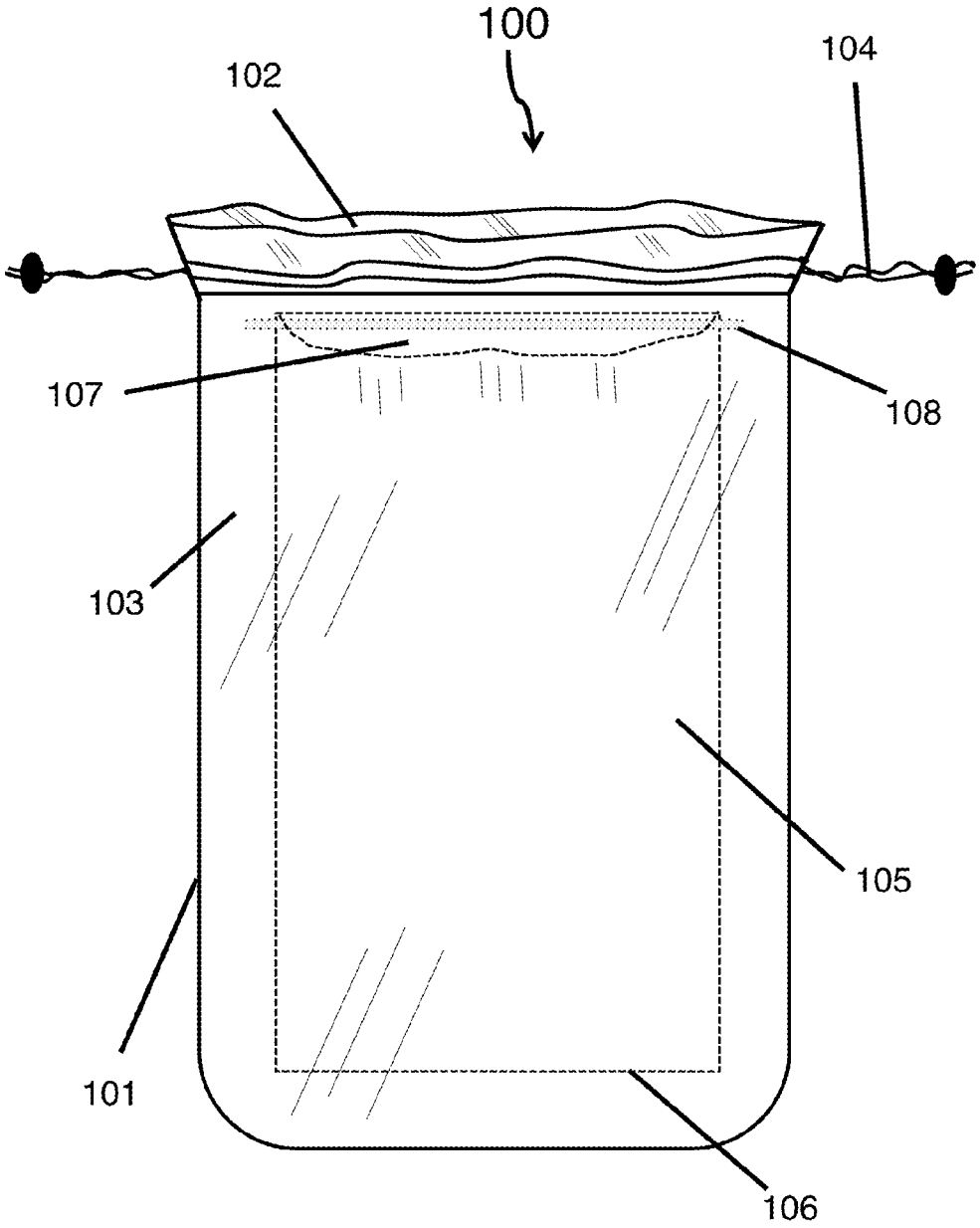
FIG. 1 is a schematic view of one embodiment of a footwear bag of the invention.

FIG. 1 depicts one embodiment of a footwear bag 100 of the invention. The bag comprises a flexible body 101 having a bag opening 102 at the top. As such, the bag defines an internal chamber 103. In addition, the bag comprises a means 104 for holding the bag in a closed position. In this exemplary embodiment, the closure means 104 is depicted as a drawstring assembly. The footwear bag also comprises a fabric mitten 105 having a closed end 106 and an opposing open end 107. Mitten 105 may be removably or fixedly attached to the bag by any of a variety of attachment means 108. In the embodiment shown in FIG. 1, mitten 105 is attached to an interior side of flexible body 101 adjacent to internal chamber 103 and near opening 102 of bag 100 and having stitching as attachment means 108. It is to be noted that mitten 105 is not configured for closing and as such lacks a mean for closure.

Bag 100 may be any size that is appropriate for holding footwear and may be sized to hold one or more shoe, boot, or other type of footwear, but is typically sized for holding two pieces of footwear, such as a pair of shoes or boots. In some embodiments, flexible body 101 has a generally rectangular shape. The generally rectangular shape may have one or more rounded corner. Other non-limiting, exemplary shapes useful for flexible body 101 include rectangular, square, circular, egg shape, oval, and elliptical. However, flexible body 101 may be any shape that is suitable for inserting, removing, and holding footwear.

Flexible body 101 is constructed from fabric. Many fabrics are suitable for construction, including by way of example only, flannel, silk, faux silk, cotton, polyester, voile, microfiber fabrics, synthetic fabrics, and fabric blends. However, any flexible fabric is suitable for use in making flexible body 101. In some embodiments of the invention, the fabric is a water-resistant or waterproof fabric or may be treated so as to render flexible body 101 water-resistant or waterproof. Flexible body 101 may be made by any method suitable for making flexible fabric bags and in some embodiments, further comprises an internal fabric lining. By way of example only, flexible body 101 may be made from a single piece of fabric, folded and sewn together at the edges, leaving one side unsewn to form opening 102. In another example, flexible body 101 may be made from different panels, and optionally a bottom panel, stitched together to form a body with an opening at the top. In some embodiments, material at or near the bottom and/or sides may be folded inward and secured or sewn in such a position. Numerous methods for making flexible bags are known to those of skill in the art.

In embodiments of the invention, bag 100 comprises a means for closure or a closure means 104 for securing the bag in a closed position and for retaining footwear in the bag. In embodiments of the invention, closure means 104 may comprise any means useful for holding a fabric bag in a closed position. Exemplary closure means 104 include single-string or double-string drawstring cords. By way of example only, double-string drawstring cords are shown in the accompanying FIGURES. Other exemplary closure means include hook and loop fasteners (e.g., VELCRO®), zippers, snaps, magnets, and combinations thereof. Typically closure means 104 are affixed to bag 100 at locations adjacent to bag opening 102.

Mitten 105 is configured and sized for receiving at least the thumb and fingers of a human hand and is of a size and shape that allows for insertion of the hand through mitten opening 107. Mitten 105 is made from a fabric that is suitable for cleaning, shining, and and/or polishing of footwear, including by way of example only, flannel, silk, faux silk, cotton, microfiber fabrics, synthetic fabrics, and fabric blends. Mitten 105 may be made by any of a variety of suitable methods for use with fabrics. By way of example only, mitten 105 may be made from a single piece of fabric, folded and sewn at the edges, leaving an opening 107 for insertion of a hand. Mitten 105 may also be made from different panels and stitched together leaving an opening 107 for insertion of a hand.

Figure 2:
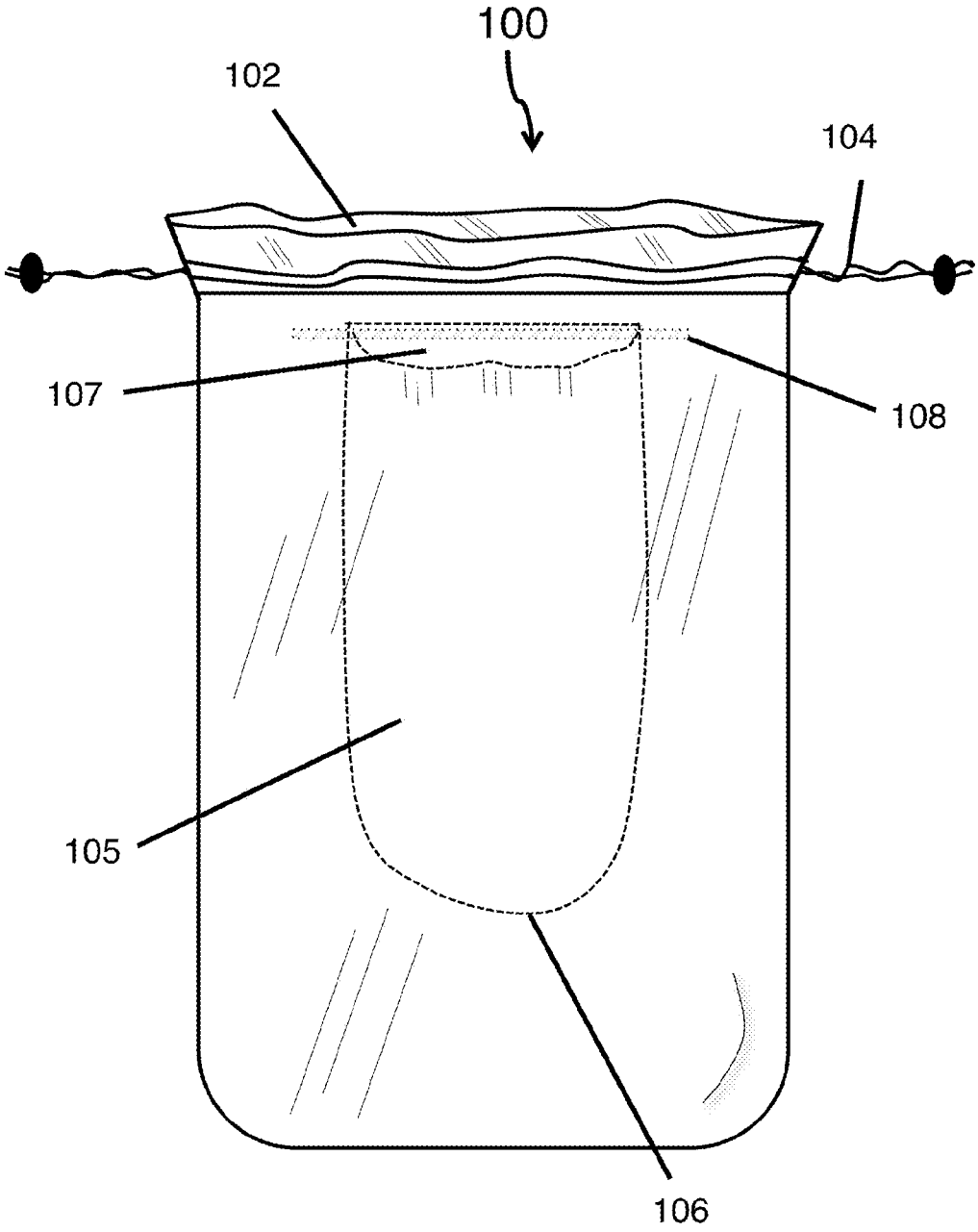
FIG. 2 is a schematic view of one embodiment of a footwear bag of the invention depicting a generally rectangular shaped mitten with a rounded end.
Figure 3:
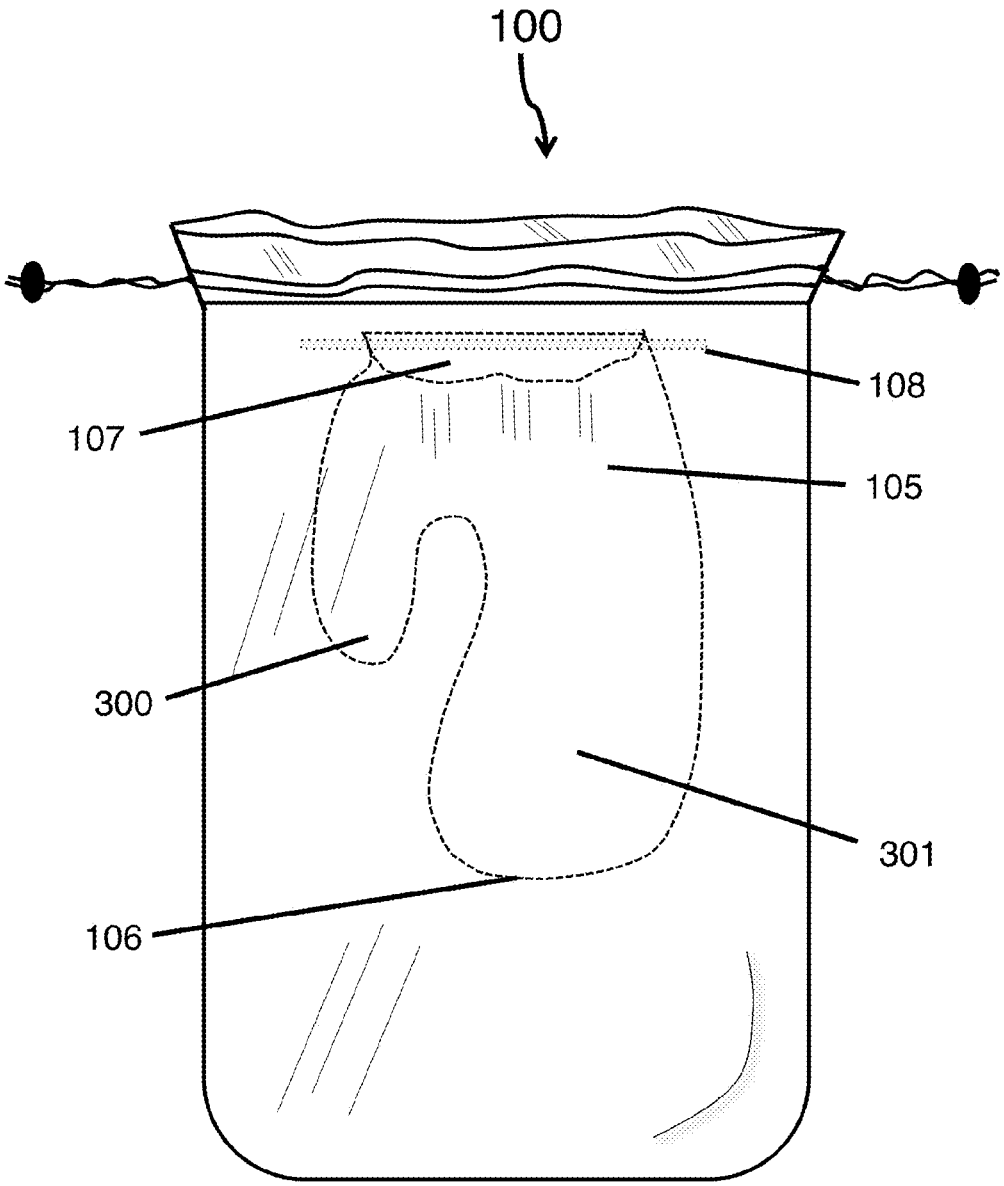
FIG. 3 is a schematic view of one embodiment of a footwear bag of the invention depicting an aspect of the invention wherein the mitten has separate sections for receiving a thumb and fingers.
Figure 4:
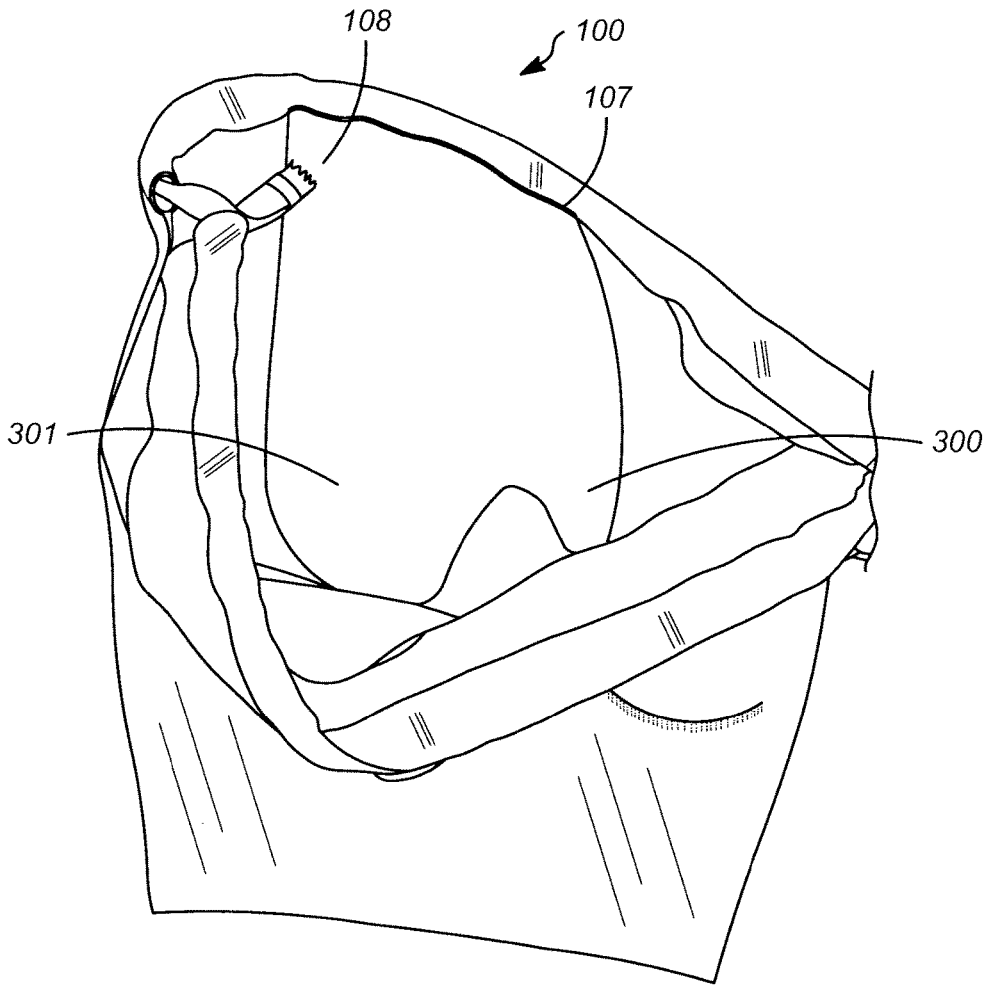
FIG. 4 is an image depicting an aspect of the invention wherein the mitten has separate sections for receiving a thumb and fingers.

Exemplary shapes for mitten 105 that are useful in embodiments of the invention include rectangular as shown in FIG. 1, generally rectangular with a rounded closed end 106 as depicted in FIG. 2, square or generally square with or without rounded corners or a rounded closed end, circular, oval, and the like. In some specific embodiments of the invention, mitten 105 has a generally rectangular shape or a generally square shape.

In other specific embodiments, such as the exemplary embodiments shown in FIG. 3, FIG. 4, FIG. 5, and FIG. 6, mitten 105 comprises a thumb-receiving section 300 and a fingers-receiving section 301. In some aspects of the invention, thumb-receiving section 300 and fingers-receiving section 301 have essentially equal sizes, while in other aspects of the invention, sections 300 and 301 are of different sizes, as shown in FIG. 3, FIG. 4, FIG. 5, and FIG. 6, such that thumb-receiving section 300 is smaller than fingers-receiving section 301.

Figure 5:
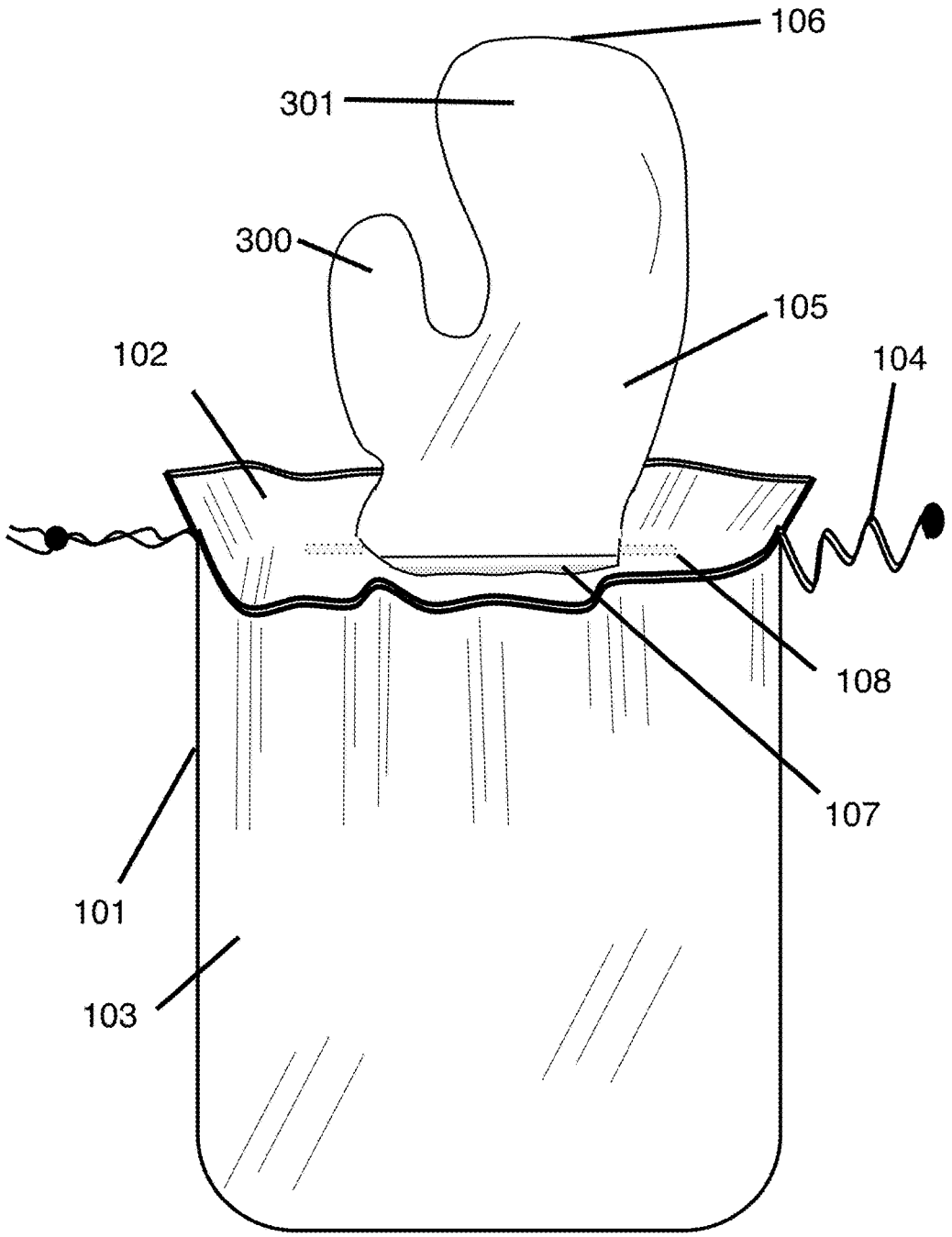
FIG. 5 is a schematic view of an embodiment of a footwear bag of the invention showing the mitten extended to a position outside of the flexible body and ready for use.

In the exemplary embodiment shown in FIG. 5, mitten 105 is shown in a position that is ready for performing footwear maintenance, such as cleaning or polishing shoes, typically after removal of footwear from bag 100. Here, bag opening 102 is shown as widened, allowing for the passage and extension of mitten 105 through bag opening 102 to a position outside of flexible body 101. Mitten 105 is shown as extending from flexible body 101 to the outside of the bag body. Mitten closed end 106 extends outward from internal chamber 103. For use in this embodiment, a hand is inserted into mitten 105 through mitten opening 107. A thumb is positioned in thumb-receiving section 300 and typically two or more fingers are inserted in fingers-receiving section 301. The "mittened" or "gloved" hand can then be used for removing dirt or other soiling on footwear or to shine, polish, dust, or otherwise clean the footwear. Users may obviously choose how many fingers will be inserted into fingers-receiving section 301. For purposes of the invention, a mitten that is "extendable" from, "extending" from, or "extends" from flexible body 101 refers to a mitten that can be positioned or moved to a position essentially outside of internal chamber 103, such that the user can insert a hand into the mitten and use the mitten to clean footwear without flexible body 101 interfering with or hampering the cleaning process.

In some embodiments of the invention, mitten 105 is attached such that mitten open end 107 is positioned substantially adjacent to bag opening 102. FIGS. 1, 2, 3, 4, and 5 show a mitten attached to an interior side of flexible fabric body 101 and having mitten open end 107 substantially adjacent to bag opening 102. This positioning allows for easy removal from and extension of mitten 105 from flexible body 101 and for easy insertion of a hand into the mitten. In the embodiment depicted in FIG. 6, mitten 105 is attached to the drawstring cord closure means 104 at a position on mitten 105 near mitten open end 107, and mitten open end 107 is substantially adjacent to bag opening 102. For purposes of the invention, when mitten 105 is attached to closure means 104, mitten open end 107 is considered to be "substantially adjacent" to bag opening 102.

Figure 6:
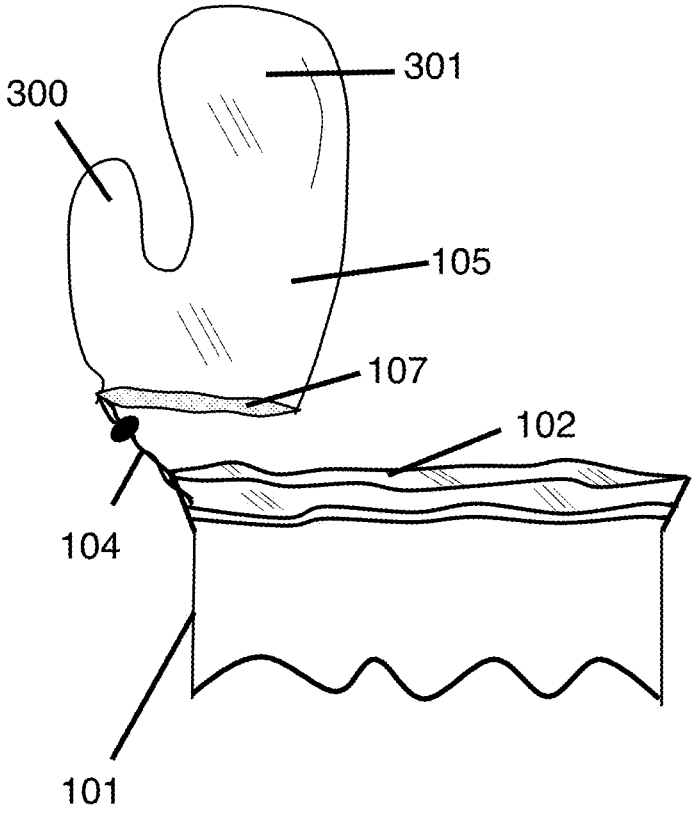
FIG. 6 is a schematic view of a top portion of a footwear bag depicting the attachment of the mitten portion of the bag to a drawstring closure means.

In some embodiments, mitten 105 is fixedly or removably attached by a means of attachment or attachment means 108 to flexible body 101. In other embodiments, mitten 105 is fixedly or removably attached to bag closure means 104, such as depicted in FIG. 6. In embodiments having mitten 105 attached to bag closure means 104, bag closure means 104 also serves as attachment means 108. In some embodiments, mitten 105 is attached to an interior side of flexible body 101 adjacent to internal chamber 103. In some aspects of the invention where mitten 105 is fixedly attached to an interior side of flexible body 101, attachment means 108 is one or more stitch affixed to secure a portion of mitten 105 to flexible body 101, at a position adjacent to bag opening 102. However, in other aspects of the invention, mitten 105 is removably attached to an interior side of flexible body 101. Means for removably attaching mitten 105 include, by way of example only, hook and loop fasteners (e.g., VELCRO® brand hook and loop fasteners), snaps, buttons, and closing hooks. Mitten 105 may also be attached to flexible body 101 with a cord or string, wherein the cord or string is fixedly attached or removably attached to flexible body 101 or mitten 105. As can be appreciated, in embodiments of the invention wherein mitten 105 is attached to flexible body 101 by a cord or string and in embodiments having mitten 105 attached to a closure means 104, for example a drawstring closure, mitten 105 is also extendable from flexible body 101.

What is claimed is:

1. A footwear bag comprising:

a) a flexible fabric body defining an internal chamber and having an opening, b) a drawstring closure for securing the bag in a closed position, and c) a flexible fabric mitten, attached to the drawstring closure and comprising a closed end and an opposing open end, the open end without a closure, wherein the mitten is configured for receiving a hand, and wherein the mitten is extendable from the flexible fabric body.

2. The footwear bag of claim 1, wherein the open end of the attached mitten is positioned substantially adjacent to the bag opening.

3. The footwear bag of claim 1, wherein the mitten comprises a first section for receiving a thumb and a second section for receiving fingers.

4. The footwear bag of claim 3, wherein the first and second sections are essentially equal in size.

5. The footwear bag of claim 3, wherein the thumb-receiving first section is smaller than the fingers-receiving second section.

6. The footwear bag of claim 1, wherein the mitten is fixedly attached to the drawstring closure.

7. The footwear bag of claim 6, wherein the mitten is attached by one or more than one stitch.

8. The footwear bag of claim 1, wherein the mitten is removably attached to the drawstring closure.

* * * * *